US006857462B2

(12) United States Patent
Sasaoka et al.

(10) Patent No.: US 6,857,462 B2
(45) Date of Patent: Feb. 22, 2005

(54) HIGH PRESSURE DIE CAST PROCESS

(75) Inventors: Kiyoshi Sasaoka, Trussville, AL (US); Tomoyuki Okada, Birmingham, AL (US); Tetsuo Yoshioka, Suzuka (JP); Rick Zimmerman, Pell City, AL (US); Jim Lewis, Trussville, AL (US); Kazuo Yuze, Trussville, AL (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/303,308

(22) Filed: Nov. 25, 2002

(65) Prior Publication Data

US 2004/0099397 A1 May 27, 2004

(51) Int. Cl.[7] ..... B22D 17/00

(52) U.S. Cl. ..... 164/113; 164/120; 164/343; 164/244; 164/312

(58) Field of Search ..... 164/113, 120, 164/137, 340, 341, 342, 343, 244, 312, 112

(56) References Cited

U.S. PATENT DOCUMENTS

| | | | | | |
|---|---|---|---|---|---|
| 3,896,705 | A | * | 7/1975 | Patton | 91/508 |
| 4,252,177 | A | | 2/1981 | Ueno et al. | |
| 4,380,261 | A | * | 4/1983 | Suzuki et al. | 164/120 |
| 4,682,930 | A | | 7/1987 | Hachisu | |
| 4,736,788 | A | | 4/1988 | Svoboda et al. | |
| 5,325,908 | A | * | 7/1994 | Sugishima | 164/341 |
| 5,381,851 | A | | 1/1995 | Bilz et al. | |
| 5,620,044 | A | * | 4/1997 | Grenkowitz et al. | 164/134 |
| 5,778,962 | A | | 7/1998 | Garza-Ondarza et al. | |
| 5,865,241 | A | * | 2/1999 | Bishenden et al. | 164/137 |
| 6,073,678 | A | | 6/2000 | Garza-Ondarza et al. | |
| 6,377,871 | B1 | * | 4/2002 | DeCamp et al. | 700/245 |
| 6,607,688 | B1 | * | 8/2003 | Vogliano et al. | 264/328.2 |

* cited by examiner

*Primary Examiner*—Kiley S. Stoner
*Assistant Examiner*—I.-H. Lin
(74) *Attorney, Agent, or Firm*—Rankin, Hill, Porter & Clark LLP; Vincent Ciamacco

(57) ABSTRACT

A high pressure die casting method including providing first and second accumulator assemblies, wherein the first accumulator assembly provides pressurized fluid toad die assembly while the second accumulator assembly provides pressurized fluid to remaining portions of the die casting machine. A barrel insert loader inserts cylinder barrels into the die assembly, and then the dies are closed to permit molten aluminum to be injected therein and thereby form the cast engine block. The dies include side gates and sub-gates through which molten aluminum is introduced into the mold. The dies are opened, and the cast engine is removed from the dies by operation of a robot arm, and a die spraying assembly is inserted between the open dies and sequentially sprays the dies, to clean and cool the dies in preparation for a subsequent casting operation.

10 Claims, 4 Drawing Sheets

HIGH PRESSURE DIE CAST PROCESS

BACKGROUND OF THE INVENTION

1. Field of the Invention

The present invention generally relates to high-pressure die casting processes and, more particularly, toward an improved high pressure die casting process for reducing cycle time in the casting process.

2. Description of Related Art

High pressure die casting is a commonly-used process in which molten aluminum is injected at high pressure into a metal mold by a hydraulically powered piston. The machinery and dies needed for the process are very costly and, accordingly, high pressure die casting is only economical when used for high volume production, such as for making aluminum engine blocks. Such machines are commercially available from a number of manufacturers, including Ube Machinery Inc., of Ann Arbor, Mich.

High pressure die casting machines conventionally include an aluminum injector assembly, a die assembly, a pressure accumulator assembly, a cast-part take-out assembly, and a die spraying assembly. The die assembly includes a fixed die and a movable die, the movable die consisting of a plurality of movable cores. The pressure accumulator supplies pressurized fluid to the entire machine, including the die assembly (for moving of the dies between an open and closed position, and for clamping the dies in the closed position), the injector assembly, die spraying assembly, etc.

To cast an engine block, a plurality of cylinder barrels are manually placed in the dies, and held therein as the dies are closed. Accordingly, the cylinder barrels are insert-molded into the engine block. The dies define side ports through which molten aluminum is injected between the dies by the injector assembly. Following casting of the engine and opening of the dies, the take-out assembly, which is a hydraulically operated device, slides the just-formed engine block out from the die assembly.

After the cast engine block is removed from the die assembly, the die spraying assembly is positioned in the open dies and sprays the dies to clean and cool them in preparation for a subsequent casting operation. The die spraying process includes application of a heat exchange medium (a heated fluid) to maintain portions of the dies at an elevated temperature to facilitate flow and distribution of molten aluminum in the next casting operation. Such a heat exchange medium is expensive, and may cause maintenance problems, as it needs to be reclaimed for recycling, etc.

While the above-referenced conventional die casting apparatus and associated method works satisfactorily, it suffers from the disadvantage that the cycle time is relatively long. The long cycle time is the result of a number of factors inherent in the aforementioned manufacturing process, including the manual insertion of cylinder barrels, delays associated with low volume supplied by the accumulator assembly, and relatively slow operation of the cast-part take out assembly. This long cycle time reduces the number of engines that can be produced in a given time period. Therefore, there exists a need in the art for a method and device that speeds the operation of the high pressure die casting apparatus and thereby reduces the cycle time.

SUMMARY OF THE INVENTION

The present invention is directed toward an improved high pressure die casting apparatus and toward an improved method of operating the high pressure die casting apparatus that reduces the cycle time and thereby permits relatively faster casting of engine blocks.

In accordance with the present invention, a method for operating a high pressure die casting machine for casting an engine block is provided. The high pressure die casting machine includes a die assembly, a molten aluminum injector assembly, and a die spraying assembly. The method comprises the steps of providing a first accumulator assembly and a second accumulator assembly wherein, according to a preferred method, the first accumulator assembly is dedicated to supplying pressurized fluid to the die assembly while the second accumulator assembly supplies pressurized fluid to a remaining portion of the die casting machine.

In further accordance with the inventive method, a barrel inserter is operated to place cylinder barrel inserts in the die assembly, and then the dies are closed so as to form an engine block mold. The engine block mold comprises first and second dies that cooperate to define a plurality of gates through which molten aluminum is directed into an engine-forming cavity of the mold, The plurality of gates include a plurality of side gates and a plurality of sub-gates.

In further accordance with the present invention, molten aluminum is injected into the engine block mold and, after a predetermined time period, the dies are opened to reveal the cast engine block. An articulated robot arm is then moved into alignment with the cast engine block, grasps and lifts the cast engine block, and removes the cast engine block from the die assembly. Once the cast engine block is out of the dies, a die spraying assembly is moved into alignment with the dies, and the die spraying assembly sprays fluids onto the dies so as to clean and cool the dies.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
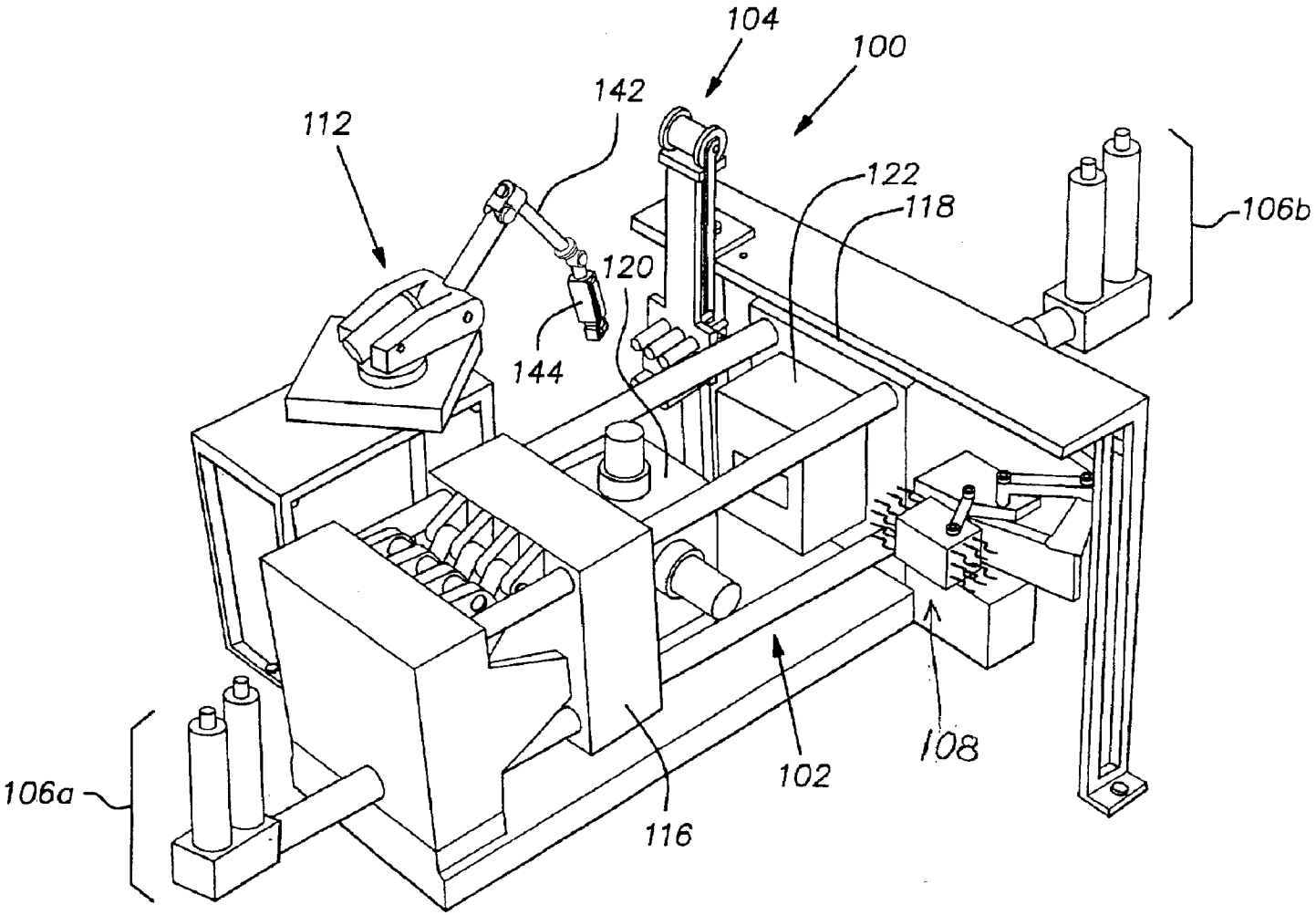
FIG. 1 schematically illustrates a high pressure die casting machine.
Figure 2:
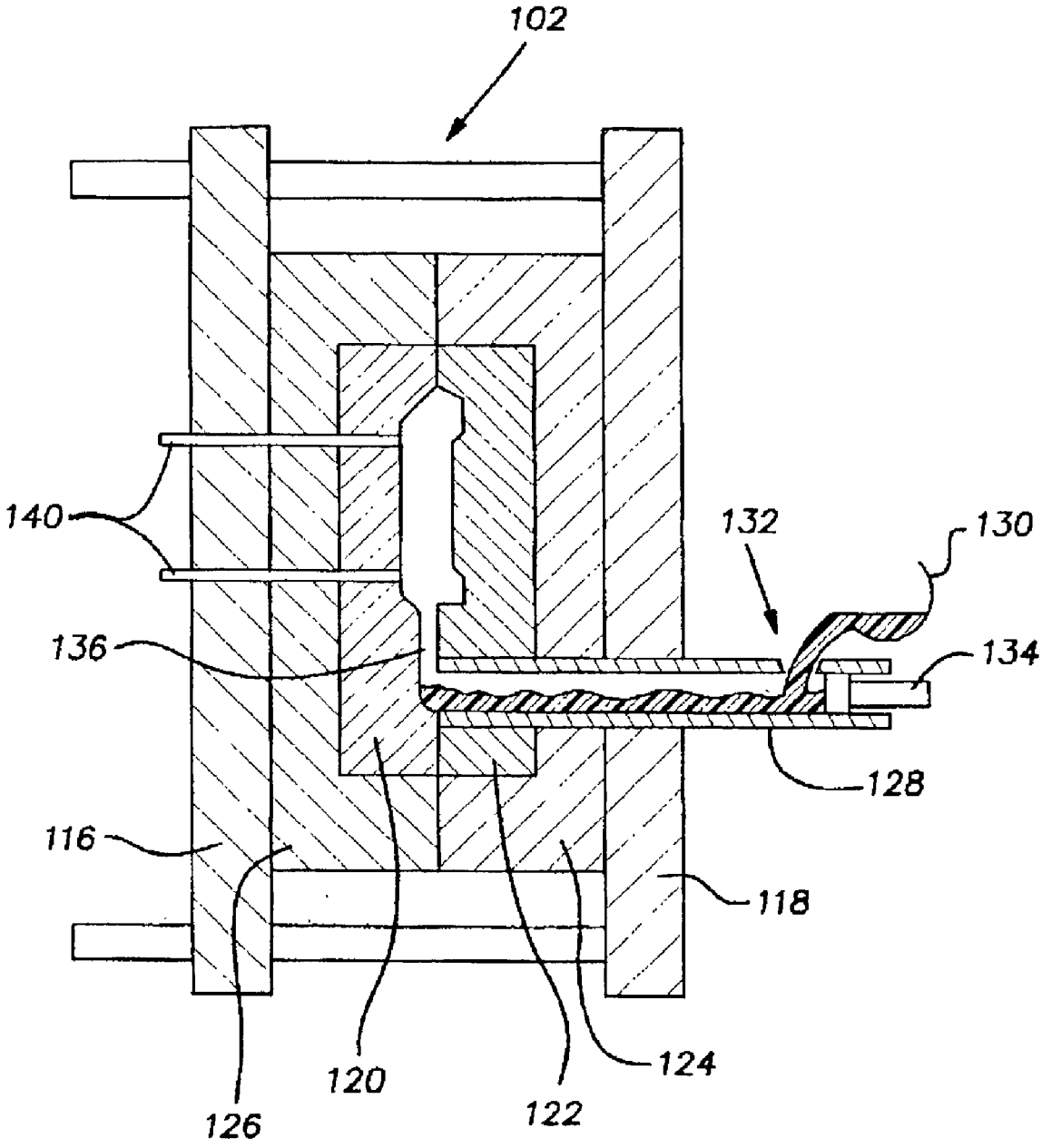
FIG. 2 schematically illustrates a casting apparatus and process.

The present invention is directed toward a method of operating a high-pressure die casting assembly to improve the cycle time thereof. Generally, the high-pressure die casting assembly 100 includes a die assembly 102, a barrel insert loader 104, first and second accumulator assemblies 106*a*, 106*b*, a die spraying assembly 108, an aluminum injector assembly 110, and a part removal assembly 112.

The die assembly 102 includes a movable platen 116, a fixed platen 118, a moving die 120, a fixed die 122, as well as bolsters 124, 126. The fixed die 122 is secured to the fixed platen 118, and has an injection cylinder 128 extending therethrough by means of which molten aluminum is injected into the die assembly 102, as will be discussed more fully hereinafter. A fixed-die bolster 124 is received between the fixed die 122 and the fixed platen 118. Similarly, the movable die 120 is fixed to the movable platen 116, and a movable-die bolster 126 is received between the movable die 120 and the movable platen 116, as illustrated.

The movable die 120 includes a plurality of cores that are movable between an open position and a closed position. More specifically, the movable die 120 preferably includes an upper core, a lower core, and first and second lateral cores. The upper and lower cores are movable between an open position and a closed position. More specifically, the upper and lower cores are vertically movable toward and away from each other and are adapted to capture the cylinder barrels. The first and second lateral cores are also movable laterally between an open position and a closed position. More specifically, the first and second lateral cores are movable toward and away from one another, and cooperate with the upper and lower cores to define the movable die. When the upper, lower, and lateral cores are in the closed position, the movable die 120 is moved into position abutting the fixed die 122 and, thus, fixed and movable dies 122, 120 cooperate to define an engine block mold into which molten aluminum is injected. Since such multi-core dies are well known in the art, they have not been specifically illustrated herein.

The barrel insert loader 104 is movable into position between the open dies 120, 122 and places the cylinder barrels into the moving die 120 to be insert-molded into the engine block (step 300). Once the barrels are properly positioned, the die assembly closes therearound (step 302) to define a mold into which molten aluminum is injected to form the engine block, as will be apparent from the following discussion.

Figure 3:
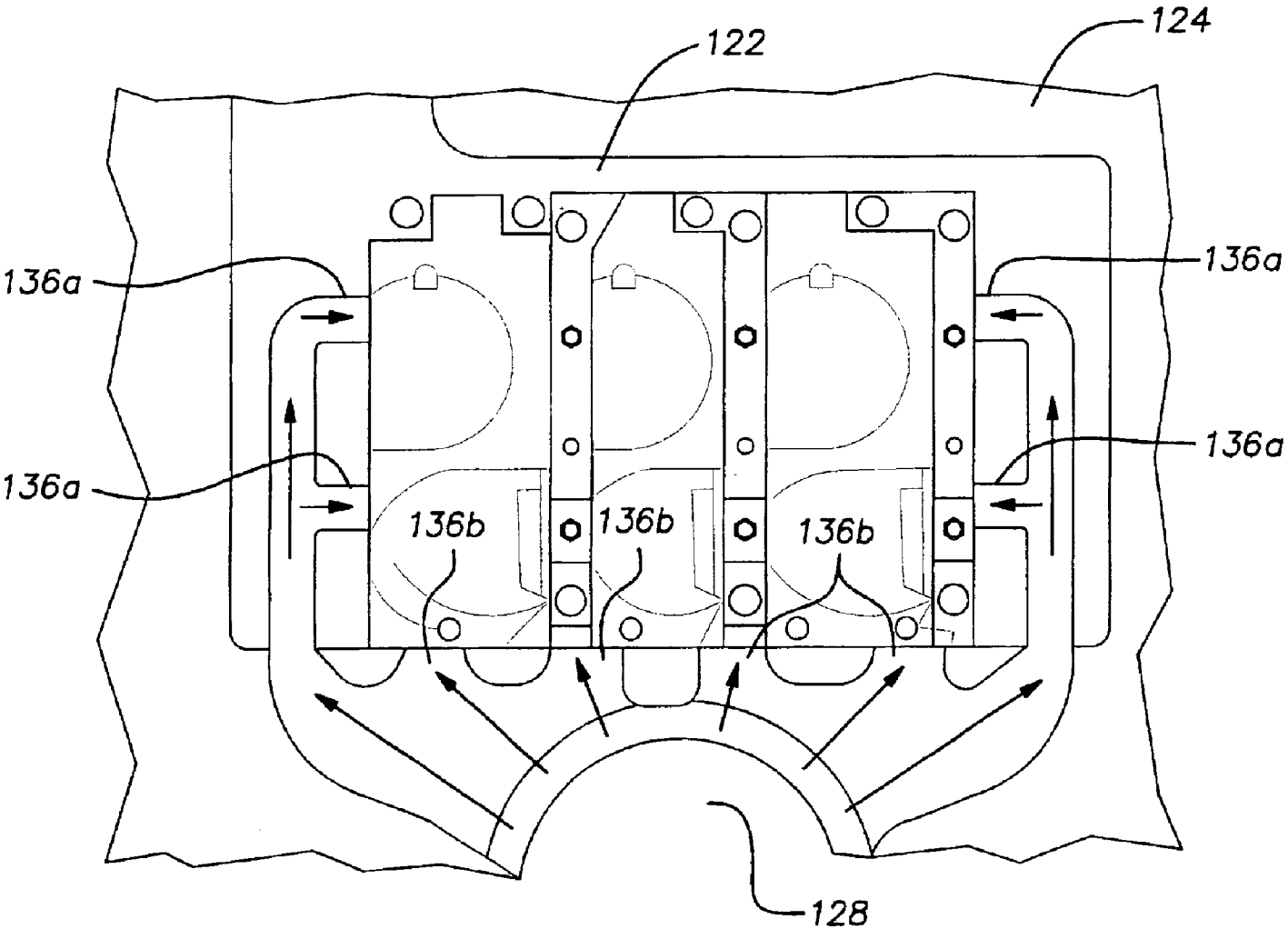
FIG. 3 illustrates improved gating on a fixed die according to the present invention; and, FIG. 4 is a flow chart illustrating steps according to the method of the present invention.
Figure 4:
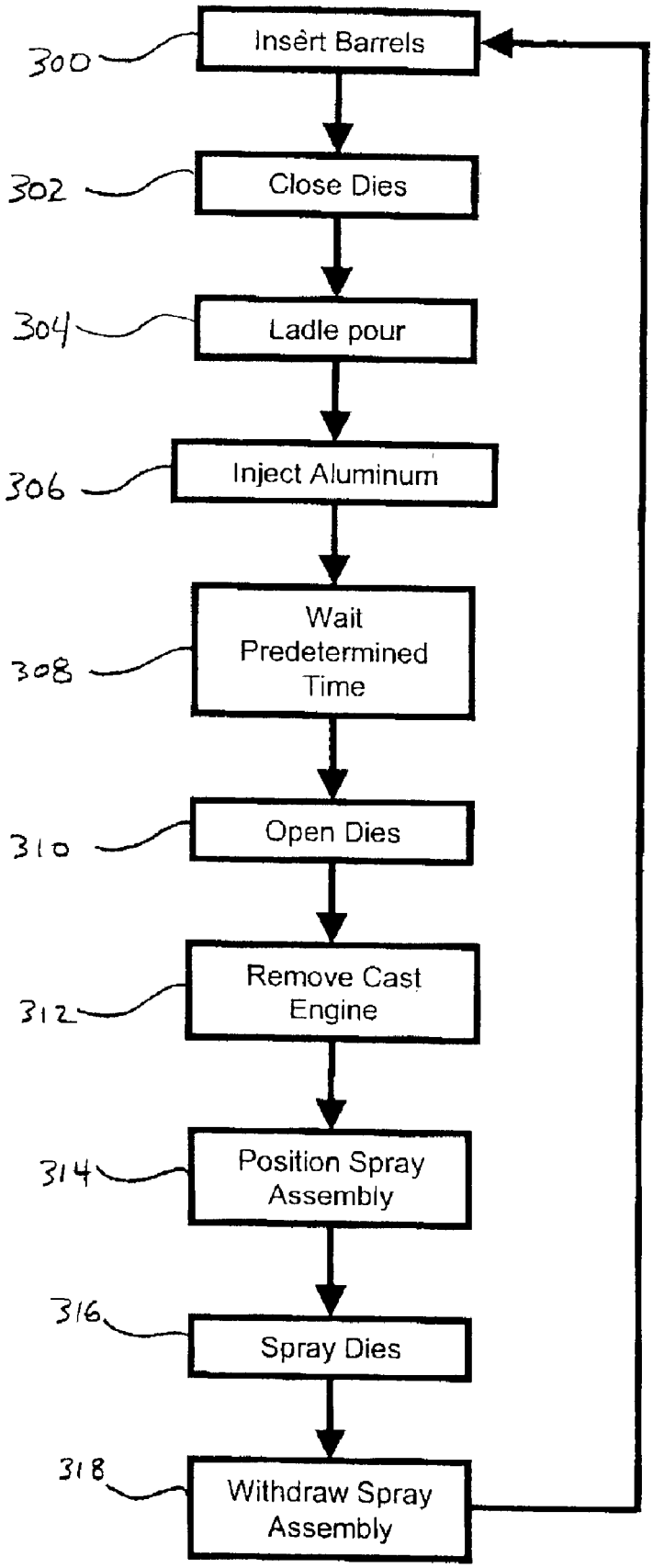

Molten aluminum is taken from an aluminum bath by a ladle 130 and poured into a shot sleeve 132 (step 304) that communicates with the injection cylinder 128. An axially driven piston or ram 134 pressurizes and injects the molten aluminum from the injection cylinder into the engine block mold (step 306). The dies 120, 122 cooperate to define gates through which molten aluminum from the injection cylinder 128 is injected into the engine block mold. With reference to FIG. 3, the gates include side gates 136*a* and sub-gates 136*b*. As such, the molten aluminum enters the mold from multiple directions, which provides better distribution and flow of the aluminum in the engine block, keeps the temperature of the molten aluminum relatively high as it flows into the die assembly 102, and thereby a better molding result. Prior to the present invention, only side gates were provided by the engine-forming dies. However, it has been found that providing the sub-gates 136*b* is particularly advantageous as it results in better-cast parts due to increased flow and temperature of the aluminum entering the mold. Moreover, since the aluminum retains its temperature while flowing into and distributing throughout the mold, it is not necessary with the present invention to supplementally heat the dies (such as with a heat transfer fluid during spraying), as is required in methods according to the prior art.

The dies 120, 122 stay closed a predetermined time period following injection of the molten aluminum to permit the engine block to solidify (step 308). Thereafter, the movable die 120 is opened or "popped" off the fixed die 122 (step 310), and the just-cast engine block is positioned for removal from the die assembly by the part removal assembly 112. Ejectors 140 assist in separating the engine block from the movable die 120.

The part removal assembly 112 includes an articulated robot arm 142 having an engine grasping chuck 144. The robot arm 142 is moved into position such that the engine grasping chuck 144 is between the fixed and movable dies 122, 120. Thereafter, the engine grasping chuck 144 is moved into engagement with the engine block, grasps the engine block, and lifts the engine block off the movable die 120.

Once the engine block is removed from the dies (step 312), the die spraying assembly 108, which is movably mounted adjacent the die assembly 102, is moved between the dies 120, 122 (step 314). The die spraying assembly 108 sprays pressurized fluid via a plurality of directional outlets onto the movable and fixed dies 122, 120 (step 316). The pressurized fluid that is applied to the dies 120, 122 preferably includes water, die lube, and anti-solder, which are preferably sprayed sequentially. Following the application of the various fluids to the dies, the die spraying assembly 108 blows air over the die surfaces to remove any retained fluid from the dies. The die spraying assembly 108 is then removed (step 318), and the barrel loading assembly 104 moves into position to insert the cylinder barrels, and the process continues.

Although not described in detail to this point, the accumulator assemblies 106*a*, 106*b*, and the pressurized fluid provided thereby, are integrally included in the foregoing discussion as the accumulator assemblies provide motive energy/pressure for the casting process. The first accumulator assembly 106*a* is dedicated to providing pressurized fluid that is used to move the die assembly 102, and the movable cores associated therewith, and to clamp the dies 120, 122 together during the aluminum injection step. The second accumulator assembly 106*b* provides motive energy to the injector assembly 110, the barrel loading assembly 104, the die spraying assembly 108, and the remaining movable portions of the casting assembly 100, with the exception of the robot, which includes its own dedicated drive means or motor.

By providing the dies 120, 122 with their own dedicated accumulator assembly 106*a*, there is always sufficient energy to move and clamp the dies. Moreover, since the second accumulator assembly 106*b* is provided for the other portions of the machine, the movement of portions of the die assembly 102 does not delay or impede subsequent movement of the die spraying assembly, which has been problematic in the prior art.

While the method of the present invention has been described herein with particularity, it is considered apparent that the invention is not limited thereto. Rather, insofar as the method is capable of numerous modifications, rearrangements, and replacements of steps, the present invention is only to be defined by the claims appended hereto.

What is claimed is:

1. A method for operating a high pressure die casting machine for casting an engine block, said high pressure die casting machine including a die assembly having a pair of dies, a molten aluminum injector assembly, and a die spraying assembly, comprising the steps of:

a) providing a first accumulator assembly and a second accumulator assembly, said first accumulator assembly being dedicated to supplying pressurized fluid to move the die assembly while said second accumulator assembly supplies pressurized fluid to provide motive energy to a remaining portion of the die casting machine;

b) operating a barrel inserter to place cylinder barrel inserts in the die assembly;

c) closing the dies so as to form an engine block mold;

d) injecting molten aluminum into the engine block mold;

e) after a predetermined time period, opening the dies to reveal the cast engine block;

f) moving an articulated robot arm into alignment with the cast engine block;

g) grasping and lifting the cast engine block with the robot arm, and thereby removing the cast engine block from the die assembly;

h) moving the die spraying assembly into alignment with the dies; and, i) spraying a fluid from the die spraying assembly so as to clean and cool the dies.

2. The method according to claim 1, comprising the steps of repeating steps (b)–(i) to form additional engine blocks.

3. The method according to claim 1, wherein the pressurized fluid supplied to the die assembly by the first accumulator assembly provides motive power to move and clamp the dies, and wherein the dedication of the first accumulator to the die assembly permits the dies to be moved without delaying the subsequent movement of the die spraying assembly.

4. A method for operating a high pressure die casting machine for casting an engine block, said high pressure die casting machine including a die assembly having a pair of dies, a molten aluminum injector assembly, and a die spraying assembly, comprising the steps of:

a) providing an accumulator assembly for supplying pressurized fluid to move the die casting machine;

b) operating a barrel inserter to place cylinder barrel inserts in the die assembly;

c) closing the dies so as to form an engine block mold having opposing first and second sides and opposing third and fourth sides, said engine block mold comprising first and second dies that cooperate to define a plurality of gates through which molten aluminum is directed into an engine-forming cavity of the mold, said plurality of gates including first and second side gates and a plurality of sub-gates, said first and second side gates being disposed on the first and second sides of the engine block mold, respectively, and said sub-gates being disposed on the third side of the engine block mold;

d) injecting molten aluminum into the engine block mold through said first and second side gates and said plurality of sub-gates such that molten aluminum enters the engine-forming cavity through the first side gate, the second side gate and the sub-gates in different directions, respectively;

e) after a predetermined time period, opening the dies to reveal the cast engine block;

f) moving an articulated robot arm into alignment with the cast engine block;

g) grasping and lifting the cast engine block with the robot arm, and thereby removing the cast engine block from the die assembly;

h) moving the die spraying assembly into alignment with the dies; and, i) spraying a fluid from the die spraying assembly so as to clean and cool the dies.

5. The method according to claim 4, comprising the steps of repeating steps (b)–(i) to form additional engine blocks.

6. A method for operating a high pressure die casting machine for casting an engine block, said high pressure die casting machine including a die assembly having a pair of dies, a molten aluminum injector assembly, and a die spraying assembly, comprising the steps of:

a) providing a first accumulator assembly and a second accumulator assembly, said first accumulator assembly being dedicated to supplying pressurized fluid to move the die assembly while said second accumulator assembly supplies pressurized fluid to provide motive power to a remaining portion of the die casting machine;

b) operating a barrel inserter to place cylinder barrel inserts in the die assembly;

c) closing the dies so as to form an engine block mold, said engine block mold comprising first and second dies that cooperate to define a plurality of gates through which molten aluminum is directed into an engine-forming cavity of the mold, said plurality of gates including a plurality of side gates and a plurality of sub-gates;

d) injecting molten aluminum into the engine block mold through said plurality of side gates and said plurality of sub-gates;

e) after a predetermined time period, opening the dies to reveal the cast engine block;

f) moving an articulated robot arm into alignment with the cast engine block;

g) grasping and lifting the cast engine block with the robot arm, and thereby removing the cast engine block from the die assembly;

h) moving the die spraying assembly into alignment with the dies; and, i) spraying a fluid from the die spraying assembly so as to clean and cool the dies.

7. The method according to claim 6, comprising the steps of repeating steps (b)–(i) to form additional engine blocks.

8. The method according to claim 6, wherein the pressurized fluid supplied to the die assembly by the first accumulator assembly provides motive power to move and clamp the dies, and wherein the dedication of the first accumulator to the die assembly permits the dies to be moved without delaying the subsequent movement of the die spraying assembly.

9. The method according to claim 6, wherein the side gates comprise first and second side gates that are oppositely-directed.

10. The method according to claim 9, wherein the sub-gates open into the engine-forming cavity from a direction perpendicular to the directions of the first and second side gates.

* * * * *